US006866593B1

(12) United States Patent
Cheng

(10) Patent No.: US 6,866,593 B1
(45) Date of Patent: Mar. 15, 2005

(54) GOLF CLUB SHAFT HAVING MULTIPLE METAL FIBER LAYERS

(75) Inventor: Michael H. L. Cheng, Simi Valley, CA (US)

(73) Assignee: Harrison Sports, Inc., Pacoima, CA (US)

( * ) Notice: Subject to any disclaimer, the term of this patent is extended or adjusted under 35 U.S.C. 154(b) by 0 days.

(21) Appl. No.: 09/602,049

(22) Filed: Jun. 23, 2000

(51) Int. Cl.[7] ..... A63B 53/00
(52) U.S. Cl. ..... 473/320
(58) Field of Search ..... 473/320, 321, 473/316–319, 322–323; 428/36.3, 36.9; 264/635; 156/187–188

(56) References Cited

U.S. PATENT DOCUMENTS

| | | | | |
|---|---|---|---|---|
| 1,765,709 | A | | 6/1930 | Withington |
| 3,313,541 | A | | 4/1967 | Benkoczy |
| 3,646,610 | A | | 2/1972 | Jackson |
| 3,653,882 | A | | 4/1972 | Petrasek |
| 3,998,458 | A | | 12/1976 | Inoue |
| 4,000,896 | A | * | 1/1977 | Lauraitis |
| 4,023,801 | A | | 5/1977 | VanAuken |
| 4,082,277 | A | | 4/1978 | Van Auken |
| 4,084,819 | A | | 4/1978 | Van Auken |
| 4,097,626 | A | | 6/1978 | Tennent |
| 4,119,748 | A | | 10/1978 | Verbauwhede |
| 4,135,035 | A | | 1/1979 | Branen |
| 4,157,181 | A | | 6/1979 | Cecka |
| 4,319,750 | A | | 3/1982 | Roy |
| 4,657,795 | A | | 4/1987 | Foret |
| 4,757,997 | A | | 7/1988 | Roy |
| 4,834,693 | A | | 5/1989 | Profant |
| 4,836,545 | A | | 6/1989 | Pompa |
| 4,889,575 | A | | 12/1989 | Roy |
| 4,916,029 | A | | 4/1990 | Nagle et al. |
| 5,028,464 | A | | 7/1991 | Shigetoh |
| 5,049,422 | A | | 9/1991 | Honma |
| 5,088,735 | A | | 2/1992 | Shigetoh |
| 5,093,162 | A | | 3/1992 | Fenton |
| 5,143,374 | A | | 9/1992 | Shibasaki |
| 5,156,396 | A | | 10/1992 | Akatsuka |
| 5,251,896 | A | | 10/1993 | Gerlach |
| 5,253,867 | A | | 10/1993 | Gafner |
| 5,265,872 | A | | 11/1993 | Tennent |
| 5,265,911 | A | | 11/1993 | Goode |
| 5,279,879 | A | * | 1/1994 | Takezawa |
| 5,308,062 | A | | 5/1994 | Hogan |
| 5,326,099 | A | | 7/1994 | Yamamoto |
| 5,385,767 | A | | 1/1995 | Noguchi |
| 5,437,450 | A | | 8/1995 | Akatsuka |
| 5,505,492 | A | | 4/1996 | Nelson |
| 5,545,094 | A | | 8/1996 | Hsu |
| 5,549,947 | A | | 8/1996 | Quigley |
| 5,551,691 | A | | 9/1996 | Harada |
| 5,599,242 | A | | 2/1997 | Solviche |
| 5,626,529 | A | * | 5/1997 | Roy |
| 5,665,441 | A | | 9/1997 | Suzue |
| 5,755,826 | A | | 5/1998 | Beach |
| 5,788,585 | A | * | 8/1998 | Jackson |
| 5,943,758 | A | | 8/1999 | Haas |
| 5,944,618 | A | | 8/1999 | Cheng |
| 5,957,783 | A | | 9/1999 | Cheng |
| 6,139,444 | A | | 10/2000 | Renard |
| 6,273,830 | B1 | * | 8/2001 | Takemura |
| 2002/0119829 | A1 | | 8/2002 | Cheng |

FOREIGN PATENT DOCUMENTS

| | | |
|---|---|---|
| JP | 5-161727 | 6/1993 |

OTHER PUBLICATIONS

U.S. Appl. No. 09/794,657—claims in current state.

* cited by examiner

*Primary Examiner*—Stephen Blau
(74) *Attorney, Agent, or Firm*—Henricks, Slavin & Holmes LLP

(57) ABSTRACT

A golf club shaft including a fiber reinforced resin layers and a variety of metal fibers.

35 Claims, 5 Drawing Sheets

GOLF CLUB SHAFT HAVING MULTIPLE METAL FIBER LAYERS

BACKGROUND OF THE INVENTION

1. Field of Invention

The present invention relates generally to golf clubs and, more particularly, to composite resin/fiber golf club shafts.

2. Description of the Related Art

Many substitutes have been introduced for the hard wood shafts originally used in golf club drivers and irons. Early substitute materials included stainless steel and aluminum. More recently, carbon fiber reinforced resin shafts have become popular. Such shafts are typically hollow and consist of a shaft wall formed around a tapered mandrel. The use of fiber reinforced resin has allowed golf club manufacturers to produce shafts having varying degrees of strength, flexibility and torsional stiffness. As such, manufacturers are able to produce shafts which suit the needs of a wide variety of golfers.

Nevertheless, manufactures are faced with a variety of design issues that have proven difficult to overcome using conventional fiber reinforced resin technologies. For example, some golfers prefer that the center of gravity of the shaft be shifted towards the tip of the shaft in order to increase the striking force when the club head impacts the golf ball. This can be difficult to accomplish with conventional technologies because composite materials are generally light. It is also preferable in some instances to increase the kick of the shaft. One conventional method of increasing the kick of a shaft is to use a large number of graphite fibers that have a very high modulous of elasticity. This method is, however, very expensive. Another method is to alter the shape of the shaft, as is disclosed in commonly assigned U.S. Pat. No. 5,957,783. Another design issue is the location of the shaft flex point and, more specifically, the inability of shaft designers to precisely predict the location of the flex point when designing a shaft without using excessive amounts of composite material, which can lead to weight and thickness issues.

SUMMARY OF THE INVENTION

The general object of the present invention is to provide a golf club shaft that eliminates, for practical purposes, the aforementioned problems. In particular, one object of the present invention is to provide a golf club shaft with more mass in and around the tip section than conventional shafts. Another object of the present invention is to provide a golf club shaft with increased kick that does not require a large number of carbon fibers with a high modulus of elasticity. Still another object of the present invention is to provide a golf club shaft which facilitates precise location of the flex point.

In order to accomplish these and other objectives, a golf club shaft in accordance with the present invention includes a plurality of fiber reinforced resin layers and respective pluralities of at least first and second metal fibers that are different from one another in at least one way. Use of the metal fibers allows golf club shafts to manufactured with certain properties that correspond to the fibers themselves. Use of the metal fibers also allows these properties to be achieved in a manner that is easier, more accurate, and more cost effective than can be achieved with conventional fiber reinforced resin manufacturing techniques.

For example, one embodiment of the present invention includes three different groups of metal fibers, i.e. a plurality of relatively heavy metal fibers, a plurality of relatively stiff metal fibers and a plurality of relatively resilient metal fibers. The ends of the metal fibers are aligned with the tip. The relatively heavy metal fibers preferably extend about 5 inches to about 8 inches from the tip and are primarily used to increase the mass of the shaft in and around the tip section. The relatively stiff metal fibers, which are primarily used to define the flex point of the shaft, preferably extend about 10 inches to about 16 inches from the tip. The relatively resilient metal fibers extend at least about 20 inches from the tip and are primarily used to increase the kick of the shaft.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known modes of carrying out the invention. This description is not to be taken in a limiting sense, but is made merely for the purpose of illustrating the general principles of the invention. The scope of the invention is defined by the appended claims.

Figure 1:
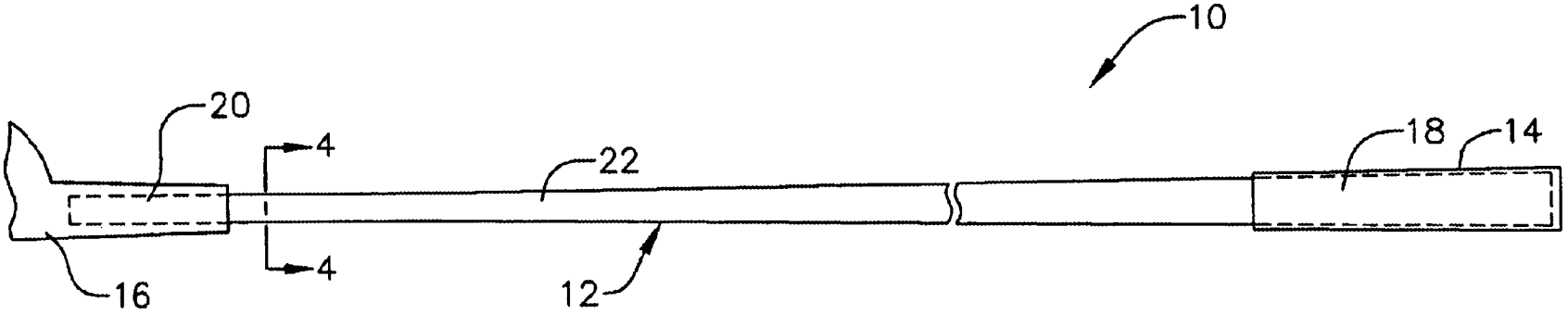
FIG. 1 is a side view of a golf club in accordance with a preferred embodiment of a present invention.

As illustrated for example in FIG. 1, a golf club shaft 10 in accordance with a preferred embodiment of the present invention includes a hollow shaft 12, a grip 14, and a club head 16. The exemplary shaft 12 is divided into three sections the grip section 18 which is covered by the grip 14, the tip section 20 which supports the club head 16, and the main body section 22 which extends from the distal end of the grip section to the proximal end of the tip section. In the illustrated embodiment, the grip section 18 is substantially cylindrical, the tip section 20 is substantially cylindrical, and the main body section 22 has a substantially constant taper. The present invention is not, however, limited to such a configuration. Other grip section, tip section and main body section configurations and shapes, such as those disclosed in commonly assigned U.S. Pat. Nos. 5,944,618 and 5,957,783, both of which are incorporated herein by reference, may also be employed.

Figure 2:
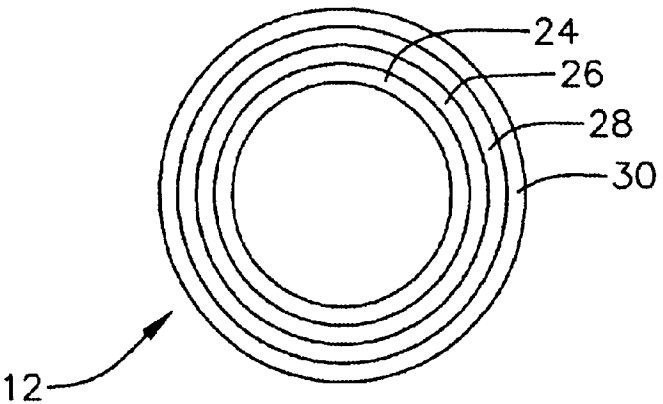
FIG. 2 is an elevation view of the butt end of the golf club shaft illustrated in FIG. 1.
Figure 3:
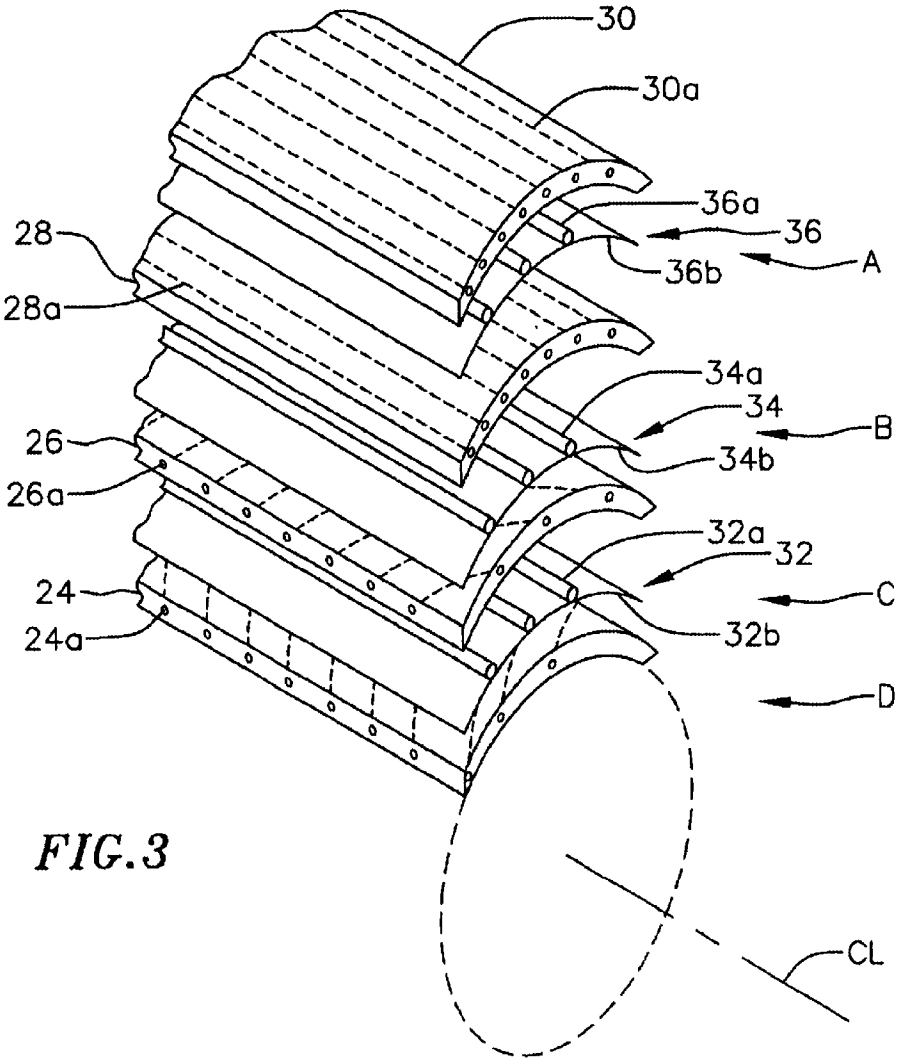
FIG. 3 is an exploded partial view of the tip end of the golf club shaft illustrated in FIG. 1.

The fiber reinforced resin composite portions of the exemplary shaft 12 may be formed in conventional fashion by wrapping multiple layers (typically 10–20 layers total) of a fiber reinforced resin composite over a mandrel until the desired wall thickness is obtained. Referring more specifically to FIGS. 2 and 3, the exemplary shaft 12 includes layer groups 24, 26, 28 and 30 which are preferably oriented at different angles with respect to the longitudinal axis of the shaft 12. Each of the groups includes a plurality of fiber reinforced resin layers. The fibers within the respective layers of each group are parallel to one another. The fibers 24*a* and 26*a* in the layers within groups 24 and 26 are angled from 30–90 degrees with respect to the longitudinal axis, while the fibers 28*a* and 30*a* in layer groups 28 and 30 are parallel to the longitudinal axis. Other layer and layer group combinations may also be employed in embodiments of the present invention. For example, layer groups 24 and 26 may be combined (a total of 5–10 layers, for example) and the individual layers arranged such that the fibers in successive layers are oriented at different angles with respect to the longitudinal axis.

It should be noted that the dimensions of the shafts illustrated in the drawings are exaggerated. Commercial embodiments of the shafts described herein may range from about 33 inches to about 46 inches in overall length. With respect to the tip section 20, the length may range from about 3 inches to about 7 inches and the outer diameter (OD) may range from about 0.370 inch to about 0.500 inch for irons and from about 0.335 inch to about 0.500 inch for woods. The length of the grip section 18 may range from about 6 inches to about 10 inches. The exemplary grip section may be either substantially cylindrical (as shown) with an OD of about 0.58 inch to about 0.62 inch or tapered from an OD of about 0.81 inch to about 1.0 inch at the butt to an OD of about 0.55 inch to about 0.70 inch at the grip section/main body section intersection. The wall thickness is preferably between about 0.6 mm and about 1.5 mm.

In accordance with the present invention, the exemplary shaft 12 also includes a number of metal fiber layers. As illustrated for example in FIGS. 3–5, the preferred embodiment of the present invention includes three metal fiber layers 32, 34 and 36 extending proximally from the tip of the tip section 20. Layers 32, 34 and 36 include respective pluralities of metal fibers 32*a*, 34*a* and 36*a*. The metals from which the fibers 32*a*, 34*a* and 36*a* are formed, as well as the length and location of the layers, will depend of the desired result. Each metal fiber layer 32, 34 and 36 in the preferred embodiment includes metal fibers formed from a different metal than the other two layers, and each extends from the tip to regions located different distances from the tip.

Figure 4:
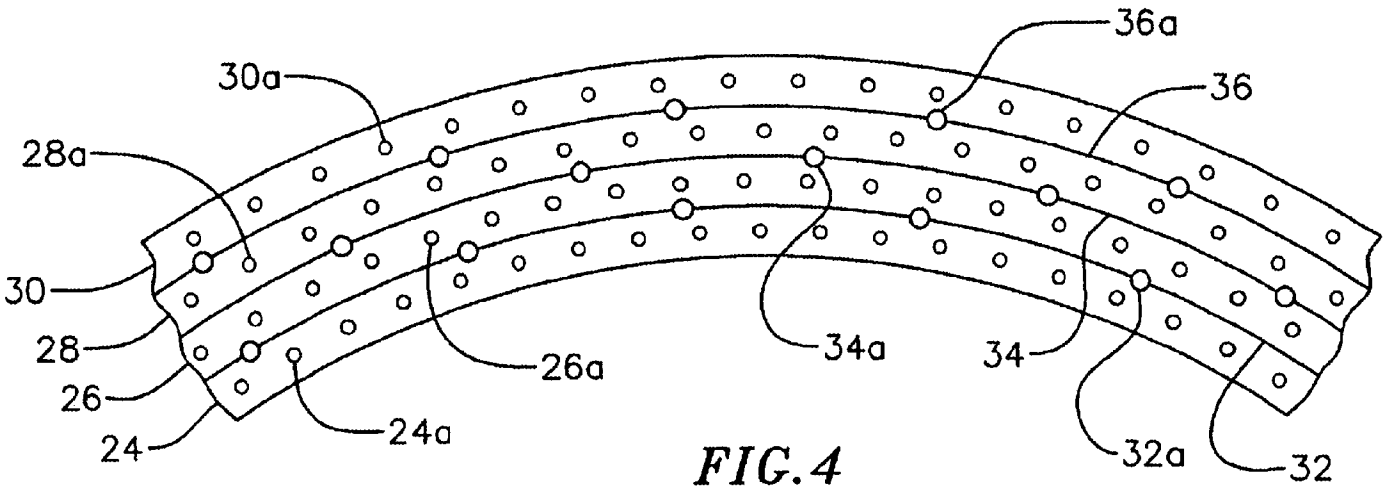
FIG. 4 is a partial section view taken through line 4—4 in FIG. 1.
Figure 5:
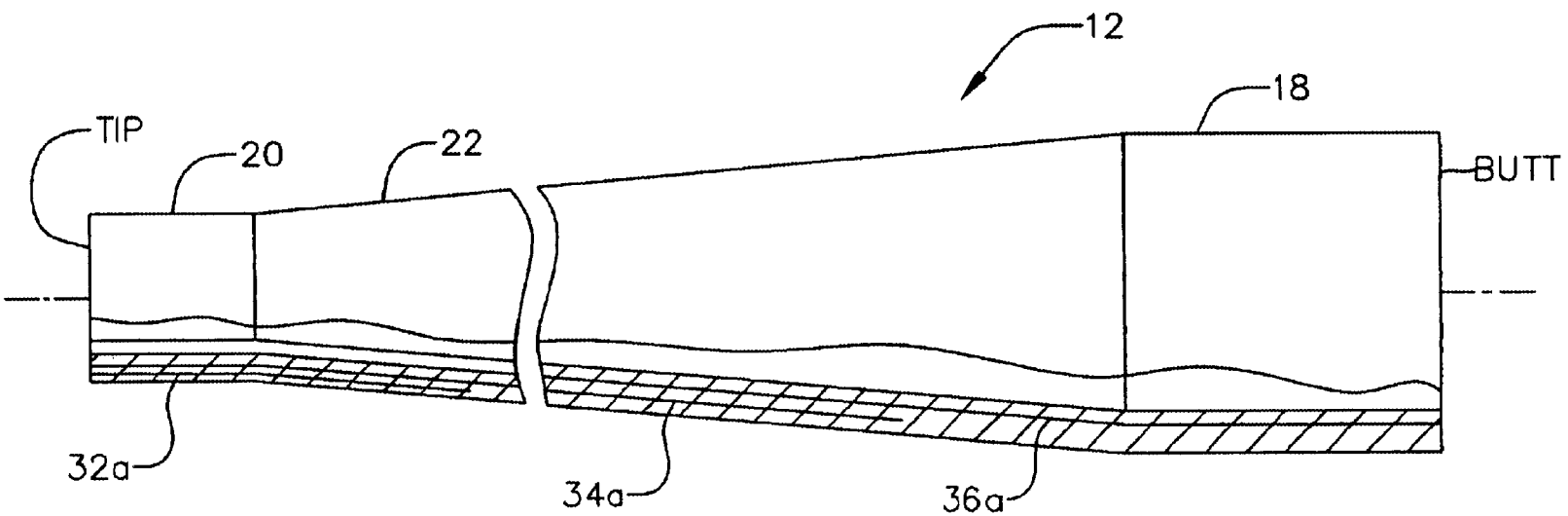
FIG. 5 is a diagrammatic view showing the relative lengths of the metal fibers in the golf club shaft illustrated in FIG. 1.

More specifically, metal fiber layer 32 in the exemplary embodiment illustrated in FIGS. 3–5 is located in region C between fiber reinforced resin layers 24 and 26. Metal fibers 32*a* are formed from a relatively heavy metal such as tungsten and extend about 5 inches to about 8 inches from the tip. Lead is another suitable metal. The primary function of the relatively heavy fibers 32*a* is to increase the mass of the shaft in and around the tip section 20. Metal fiber layer 34, which includes fibers 34*a* formed from a relatively stiff metal such as boron, is located in region B between fiber reinforced resin layers 26 and 28 and extends about 10 inches to about 16 inches from the tip. The relatively stiff metal should also be relatively light. Another suitable metal is beryllium. The primary purpose of the relatively stiff fibers 34*a* is to define the flex point of the shaft. Metal fibers 36*a* are formed from a relatively resilient metal (i.e. a metal with a relatively high modulus of elastcity) such as titanium and extend from the tip to at least about 20 inches from the tip and, if desired, all the way from the tip to the butt. Metal fiber layer 36 is located in region A between fiber reinforced resin layers 28 and 30. The relatively resilient metal should also be relatively light. The primary purpose of the relatively resilient fibers 36*a* is to increase the kick of the shaft.

Figure 6:
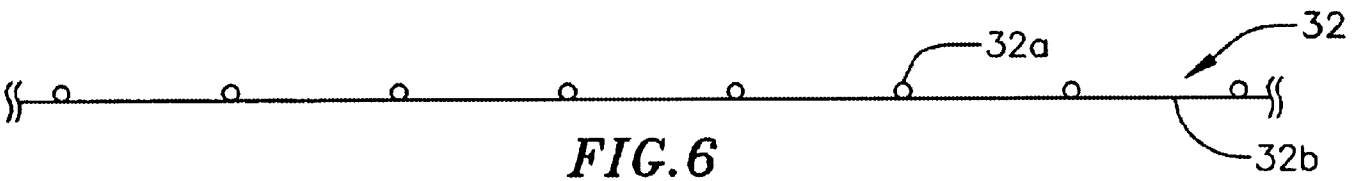
FIG. 6 is a partial end elevation view of a prepreg sheet used to form a metal fiber layer.

Referring to FIGS. 3 and 6, the metal fiber layers 32, 34 and 36 are preferably pre-preg sheets formed by winding the metal fibers 32*a*, 34*a* and 36*a* onto resin pre-impregnated fiberglass sheets (or "scrim cloth") 32*b*, 34*b* and 36*b*. Although the actual dimensions may vary, the fiberglass sheets 32*b*, 34*b* and 36*b* are relatively thin (preferably about 0.02 mm to about 0.05 mm thick) with a weight of about 20 g/m$^2$. The respective diameters of the metal fibers 32*a*, 34*a* and 36*a* in the preferred embodiment may range from about 0.002 inch to about 0.008 inch and are preferably about 0.004 inch to about 0.006 inch. The density of the metal fibers may range from about 10 fibers/inch to about 200 fibers/inch and is preferably about 20 fibers/inch. Alternatively, the metal fibers 32*a*, 34*a* and 36*a* may be incorporated into a layer of resin to form a composite pre-preg sheet. In either case, each pre-preg sheet is wrapped around the appropriate fiber reinforced resin layer during manufacture of the shaft.

Shafts in accordance with present invention are not limited to the exemplary configuration illustrated in FIGS. 3–5. Metal fiber layers 32, 34 and 36 may be relocated relative to the fiber reinforced resin layer groups 24, 26, 28 and 30 and relocated relative to one another. In addition, more than one metal fiber layer may be located in a single region between a given pair of fiber reinforced resin layer groups. Metal fiber layer 32, which includes relatively heavy fibers 32*a*, may be located in regions A, B, C (as shown) or D, either alone or in combination with one or both of the other metal fiber layers. Metal fiber layers 34 and 36, which respectively include relatively stiff and relatively resilient fibers 34*a* and 36*a*, may be located in layers A and B either alone (as shown), together and/or in combination with metal fiber layer 32.

The performance properties of shafts in accordance with the present invention may be adjusted through variations in the respective locations, lengths, metal fiber densities and other properties of the metal fiber layers 32, 34 and 36. For example, the greater the circumference of the layer, the greater the number of fibers and, therefore, the greater the effect of the metal fiber layer. Thus, for a given fiber density, the location of the metal fiber layer 32 will determine the weight of the metal fiber layer. The weight of metal fiber layer 32 may also be varied by varying the density of the fibers 32*a* within the layer and/or the diameter of the fibers. Similar adjustments may be made with respect to metal fiber layers 34 and 36. In addition, in alternative embodiments, any one of the layers may be omitted if the performance property created thereby is not desired.

Figure 8:
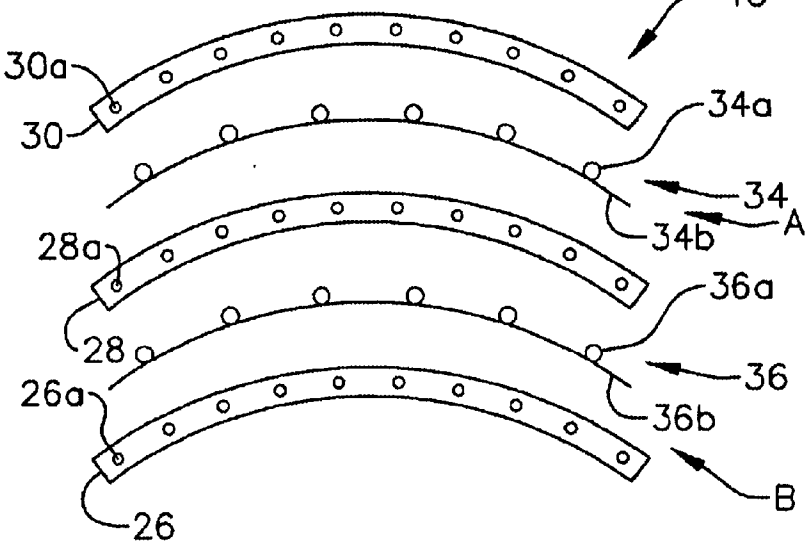
FIG. 8 is an exploded partial section view of a golf club shaft in accordance with still another preferred embodiment of the present invention taken from the same position as FIG. 4.
Figure 8:
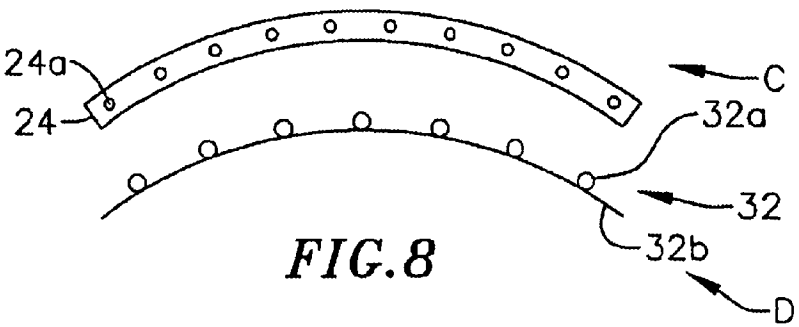
Figure 7:
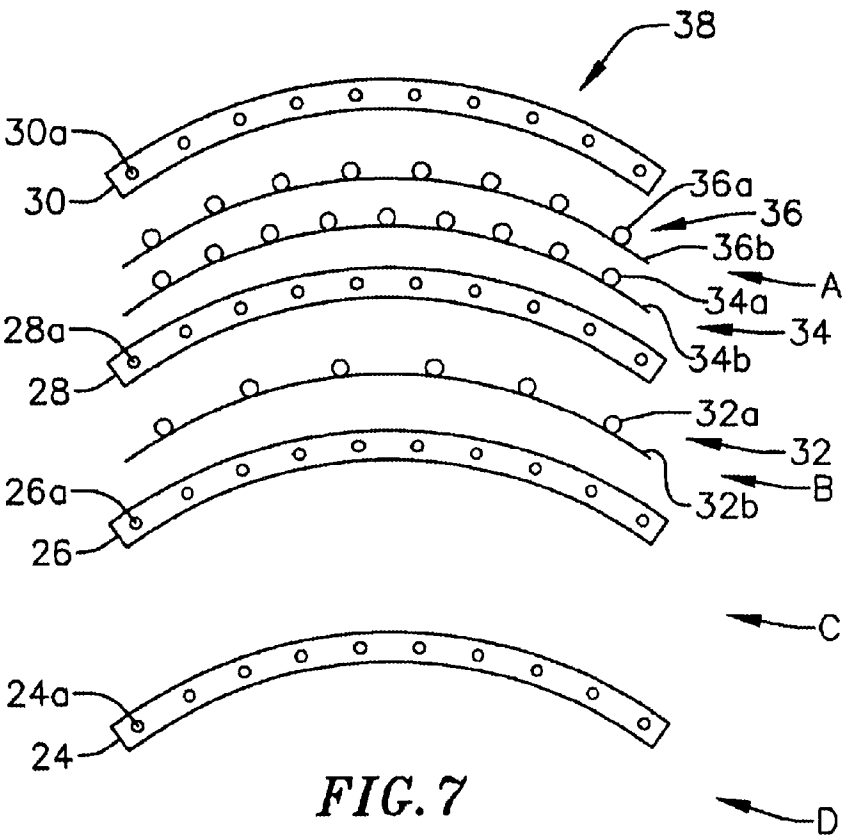
FIG. 7 is an exploded partial section view of a golf club shaft in accordance with another preferred embodiment of the present invention taken from the same position as FIG. 4.
Figure 9:
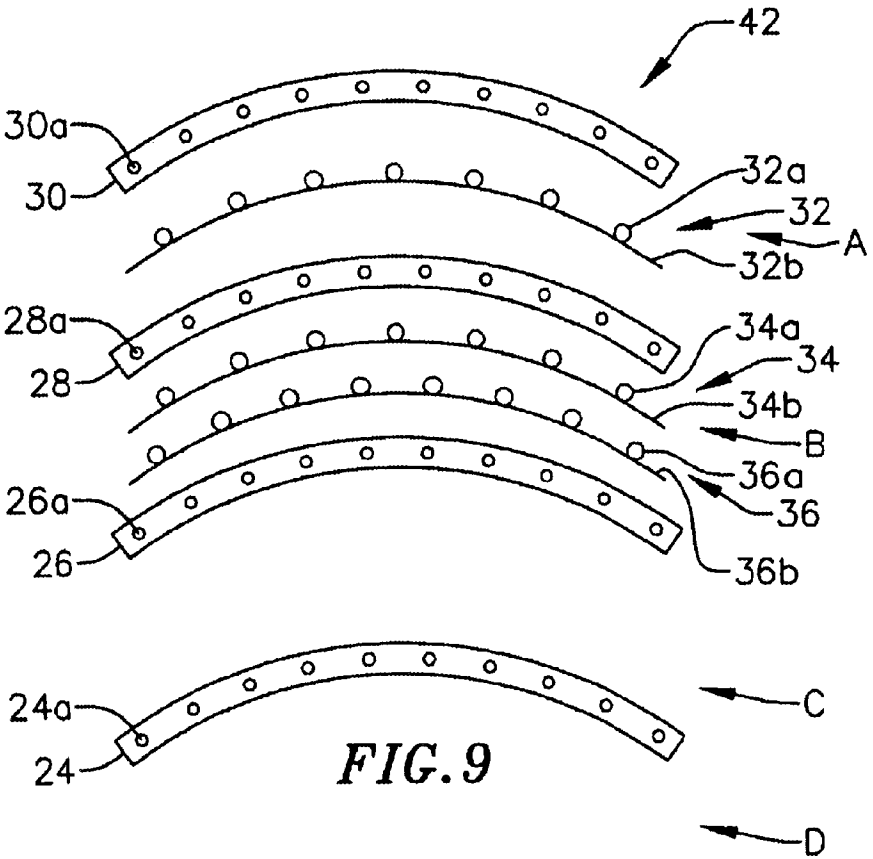
FIG. 9 is an exploded partial section view of a golf club shaft in accordance with yet another preferred embodiment of the present invention taken from the same position as FIG. 4.

By way of example, but not limitation, shafts having some of the possible alternative configurations are illustrated in FIGS. 7–9. The exemplary shaft 38 illustrated in FIG. 7 includes relatively heavy metal fibers 32*a* that are located in region B and relatively stiff and resilient metal fibers 34*a* and 36*a* that are both located in region A. As compared to shaft configuration illustrated in FIGS. 3 and 4, shaft 38 will have a greater mass in and around the tip section and will be also be stiffer.

The exemplary shaft 40 illustrated in FIG. 8 includes relatively heavy metal fibers 32*a* that are located in region D, relatively stiff metal fibers 34*a* that are located in region A, and relatively resilient metal fibers 36*a* that are located in region B. As compared to shaft configuration illustrated in FIGS. 3 and 4, shaft 40 will have a lesser mass in and around the tip section.

As illustrated for example in FIG. 9, exemplary shaft 42 includes relatively heavy metal fibers 32*a* that are located in region A, relatively stiff and resilient metal fibers 34*a* and 36*a* that are both located in region B. Shaft 42 will have a greater mass in and around the tip section than the shafts illustrated in FIGS. 3 and 4, 7 and 8. Additionally, as compared to the shaft illustrated in FIGS. 3 and 4, shaft 42 will have less kick.

Figure 10:
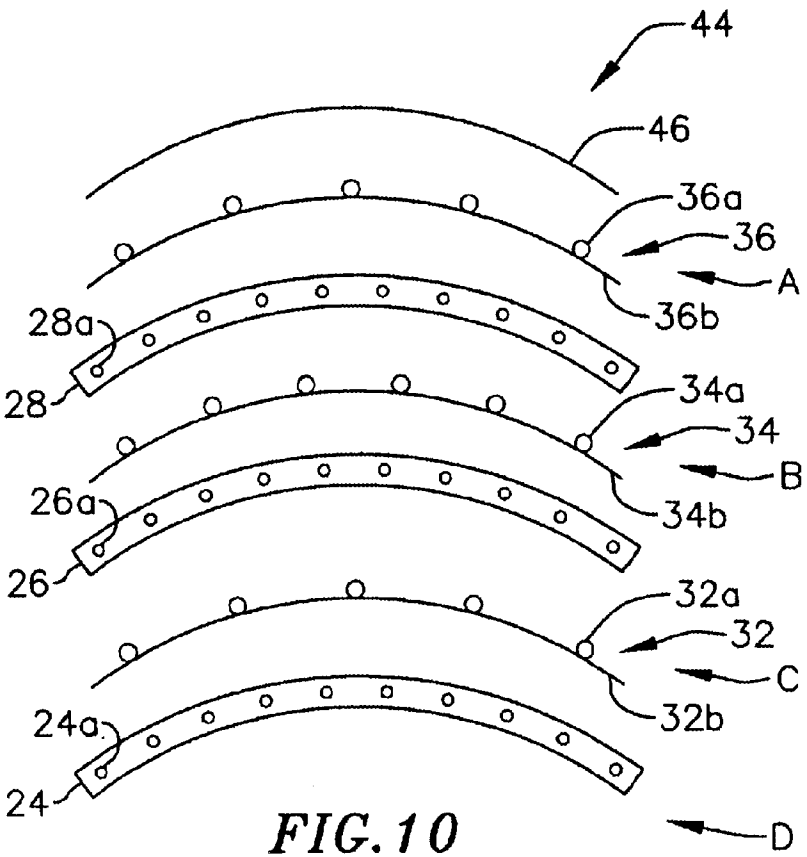
FIG. 10 is an exploded partial section view of a golf club shaft in accordance with another preferred embodiment of the present invention taken from the same position as FIG. 4.

The exemplary embodiment 44 illustrated in FIG. 10 is substantially similar to that illustrated in FIGS. 3 and 4. Here, however, the outer-most fiber reinforced resin layer group 30 has been removed and replaced by one or more resin pre-impregnated fiberglass sheets 46. One advantage of this embodiment is that the metal fibers 36*a*, which are not visible to the user through the outer-most fiber reinforced resin layer group 30, will be visible through the resin pre-impregnated fiberglass sheet(s) 46. The outer-most fiber reinforced resin layer group in any of the other exemplary embodiments described herein may also be replaced with one or more resin pre-impregnated fiberglass sheets.

The present invention may be practiced with any of the materials typically used to produce composite resin/fiber golf club shafts. Suitable resins include, for example, thermosetting resins or polymers such as polyesters, epoxies, phenolics, melamines, silicones, polimides, polyurethanes and thermoplastics. Suitable fibers include, for example, carbon-based fibers such as graphite, glass fibers, aramid fibers, and extended chain polyethylene fibers. After the successive layers of fiber reinforced resin are wrapped around the mandrel, the shaft is cured in an oven. Curing times and temperatures depend on the polymer used in the composite and are well known to those of skill in the art.

Shafts and rods having fiber reinforced layers and metal fiber layers in accordance with the present inventions also have application in devices other than golf club shafts. For example, baseball bats, bike tubes, sail masts and fishing rods may be formed with the above described layer combinations.

Although the present invention has been described in terms of the preferred embodiment above, numerous modifications and/or additions to the abovedescribed preferred embodiments would be readily apparent to one skilled in the art. It is intended that the scope of the present invention extends to all such modifications and/or additions and that the scope of the present invention is limited solely by claims set forth below.

I claim:

1. A golf club shaft, comprising:

a plurality of fiber reinforced resin layers defining a tip, a tip section, a main body section, a grip section, and a butt;

a plurality of first metal fibers, defining a first length and longitudinal ends, located between two of the fiber reinforced resin layers such that one of the longitudinal ends of each of the first metal fibers is substantially aligned with the tip;

a plurality of second metal fibers, defining a second length and longitudinal ends, located between two of the fiber reinforced resin layers such that one of the longitudinal ends of each of the second metal fibers is substantially aligned with the tip, the second length being greater than the first length;

an inner scrim cloth; and an outer-most scrim cloth;

wherein one of the plurality of first metal fibers and the plurality of second metal fibers is located between the inner and out-most scrim cloths.

2. A golf club shaft as claimed in claim 1, wherein the plurality of fiber reinforced resin layers includes a group of layers with fibers angled with respect to the longitudinal axis of the shaft and a group of layers with fibers substantially parallel to the longitudinal axis.

3. A golf club shaft as claimed in claim 1, wherein the first metal fibers comprise relatively heavy metal fibers.

4. A golf club shaft as claimed in claim 3, wherein the first metal fibers comprise tungsten fibers.

5. A golf club shaft as claimed in claim 3, wherein the first metal fibers are about 5 inches to about 8 inches in length.

6. A golf club shaft as claimed in claim 1, wherein the second metal fibers comprise relatively stiff metal fibers.

7. A golf club shaft as claimed in claim 6, wherein the second metal fibers comprise boron fibers.

8. A golf club shaft as claimed in claim 6, wherein the second metal fibers are about 10 inches to about 16 inches in length.

9. A golf club shaft as claimed in claim 1, further comprising:

a plurality of third metal fibers defining a third length located between two of the fiber reinforced resin layers, the third length being greater than the second length.

10. A golf club shaft as claimed in claim 9, wherein the third metal fibers comprise relatively resilient metal fibers.

11. A golf club shaft as claimed in claim 10, wherein the third metal fibers comprise titanium fibers.

12. A golf club shaft as claimed in claim 10, wherein the third metal fibers are at least about 20 inches in length.

13. A golf club shaft as claimed in claim 1, wherein the first and second metal fibers are substantially linear.

14. A golf club shaft as claimed in claim 1, wherein the first and second metal fibers are located between the same two resin layers.

15. A golf club shaft as claimed in claim 1, wherein metal fibers are visible through the outer-most scrim cloth.

16. A golf club shaft, comprising:

a plurality of resin layers defining a tip, a tip section, a main body section, a grip section, and a butt, at least one of the resin layers being a fiber reinforced resin layer;

an inner scrim cloth over the plurality of resin layers;

an outer-most scrim cloth;

a plurality of first metal fibers located between two of the resin layers and defining a first length; and a plurality of second metal fibers located between the inner scrim cloth and the outer-most scrim cloth, the second metal fibers being formed from a different metal than the first metal fibers and defining a second length that is greater than the first length.

17. A golf club shaft as claimed in claim 16, wherein a plurality of the resin layers are fiber reinforced resin layers.

18. A golf club shaft as claimed in claim 17, wherein the plurality of fiber reinforced resin layers includes a group of layers with fibers angled with respect to the longitudinal axis of the shaft and a group of layers with fibers substantially parallel to the longitudinal axis.

19. A golf club shaft as claimed in claim 16, wherein the first metal fibers comprise relatively heavy metal fibers.

20. A golf club shaft as claimed in claim 19, wherein the first metal fibers comprise tungsten fibers.

21. A golf club shaft as claimed in claim 16, wherein the second metal fibers comprise relatively stiff metal fibers.

22. A golf club shaft as claimed in claim 21, wherein the second metal fibers comprise boron fibers.

23. A golf club shaft as claimed in claim 16, further comprising:

a plurality of third metal fibers located between two of the resin layers, the third metal fibers being formed from a different metal than the first and second metal fibers.

24. A golf club shaft as claimed in claim 23, wherein the third metal fibers comprise relatively resilient metal fibers.

25. A golf club shaft as claimed in claim 24, wherein the third metal fibers comprise titanium fibers.

26. A golf club shaft as claimed in claim 23, wherein the first metal fibers comprise relatively heavy metal fibers, the second metal fibers comprise relatively stiff metal fibers, and the third metal fibers comprise relatively resilient metal fibers.

27. A golf club shaft as claimed in claim 26, wherein the third metal fibers define a third length and the third length is greater than the second length.

28. A golf club shaft as claimed in claim 16, wherein the first and second metal fibers are substantially linear.

29. A golf club shaft as claimed in claim 16, wherein the first and second metal fibers are located between the same two resin layers.

30. A golf club shaft as claimed in claim 16, wherein metal fibers are visible through the outer-most scrim cloth.

31. A golf club shaft, comprising:

a plurality of fiber reinforced resin layers defining a tip, a tip section, a main body section, a grip section, and a butt; and a plurality of relatively heavy metal fibers extending from the tip towards the butt, defining a first length and located between two of the fiber reinforced resin layers;

a plurality of relatively stiff metal fibers extending from the tip towards the butt, defining a second length and located between two of the fiber reinforced resin layers, the second length being greater than the first length; and a plurality of relatively resilient metal fibers extending from the tip towards the butt, defining a third length and located between two of the fiber reinforced resin layers, the third length being greater than the second length;

wherein at least one of the plurality of relatively heavy metal fibers, the plurality of relatively stiff metal fibers, and the plurality of relatively resilient metal fibers is located between a different two of the fiber reinforced resin layers than the other of the plurality of relatively heavy metal fibers, the plurality of relatively stiff metal fibers, and the plurality of relatively resilient metal fibers.

32. A golf club shaft, comprising:

a plurality of fiber reinforced resin layers defining a tip, a tip section, a main body section, a grip section, a butt and a longitudinal axis;

an inner scrim cloth over the fiber reinforced resin layers;

an outer scrim cloth; and a plurality of longitudinally extending metal fibers located between the inner and outer scrim cloths.

33. A golf club shaft as claimed in claim 32, wherein the metal fiber layers are visible through the outer scrim cloth.

34. A golf club shaft as claimed in claim 32, wherein the metal fibers are substantially parallel to the longitudinal axis.

35. A golf club shaft as claimed in claim 32, wherein the metal fibers are the only structures between the inner and outer scrim cloths.

* * * * *